US009079243B2

(12) United States Patent
Gaertner et al.

(10) Patent No.: US 9,079,243 B2
(45) Date of Patent: Jul. 14, 2015

(54) METHOD OF AND DEVICE FOR CONTROLLING OR REGULATING A TEMPERATURE

(75) Inventors: Horst Gaertner, Duesseldorf (DE); Heinz-Juergen Oudehinken, Hilden (DE); Wolfgang Sauer, Duesseldorf (DE); Thomas Heimann, Iserlohn (DE)

(73) Assignee: SMS SIEMAG AKTIENGESELLSCHAFT, Duesseldorf (DE)

( * ) Notice: Subject to any disclaimer, the term of this patent is extended or adjusted under 35 U.S.C. 154(b) by 586 days.

(21) Appl. No.: 12/734,870

(22) PCT Filed: Nov. 27, 2008

(86) PCT No.: PCT/EP2008/010076
§ 371 (c)(1),
(2), (4) Date: Aug. 27, 2010

(87) PCT Pub. No.: WO2009/071236
PCT Pub. Date: Jun. 11, 2009

(65) Prior Publication Data

US 2010/0324721 A1 Dec. 23, 2010

(30) Foreign Application Priority Data

Dec. 3, 2007 (DE) ..... 10 2007 058 109

(51) Int. Cl.
*B22D 11/22* (2006.01)
*B22D 11/12* (2006.01)

(52) U.S. Cl.
CPC ..... *B22D 11/225* (2013.01); *B22D 11/1206* (2013.01)

(58) Field of Classification Search
CPC ..... B22D 11/1206; B21B 15/0035
USPC ..... 164/122, 126, 414, 455, 458, 486; 700/146, 153, 202, 299
See application file for complete search history.

(56) References Cited

U.S. PATENT DOCUMENTS 3,358,743 A * 12/1967 Adams ..... 164/450.2
4,030,531 A 6/1977 Wunnenberg
4,463,795 A 8/1984 Chielens (Continued)

FOREIGN PATENT DOCUMENTS

DE 2444443 9/1974
DE 4417221 11/1994

(Continued)

OTHER PUBLICATIONS

Ha et al. (Numerical Analysis of secondary cooling and bulging in the continuous casting of slabs, 2001).*

(Continued)

*Primary Examiner* — Darrin Dunn
(74) *Attorney, Agent, or Firm* — Abelman, Frayne & Schwab

(57) ABSTRACT

The invention relates to a method of controlling or regulating the temperature of a cast strand (2) in a continuous casting installation (1) comprising a control or regulating unit (3) particularly for controlling or regulating the temperature in a secondary cooling of a continuous casting installation using at least one means for cooling the cast strand, characterized by a dynamic change of at least one set temperature of the cast strand on the basis of data and/or signals that are received and/or determined by the control or regulating unit.

2 Claims, 4 Drawing Sheets

(56) References Cited

U.S. PATENT DOCUMENTS

Figure 1:
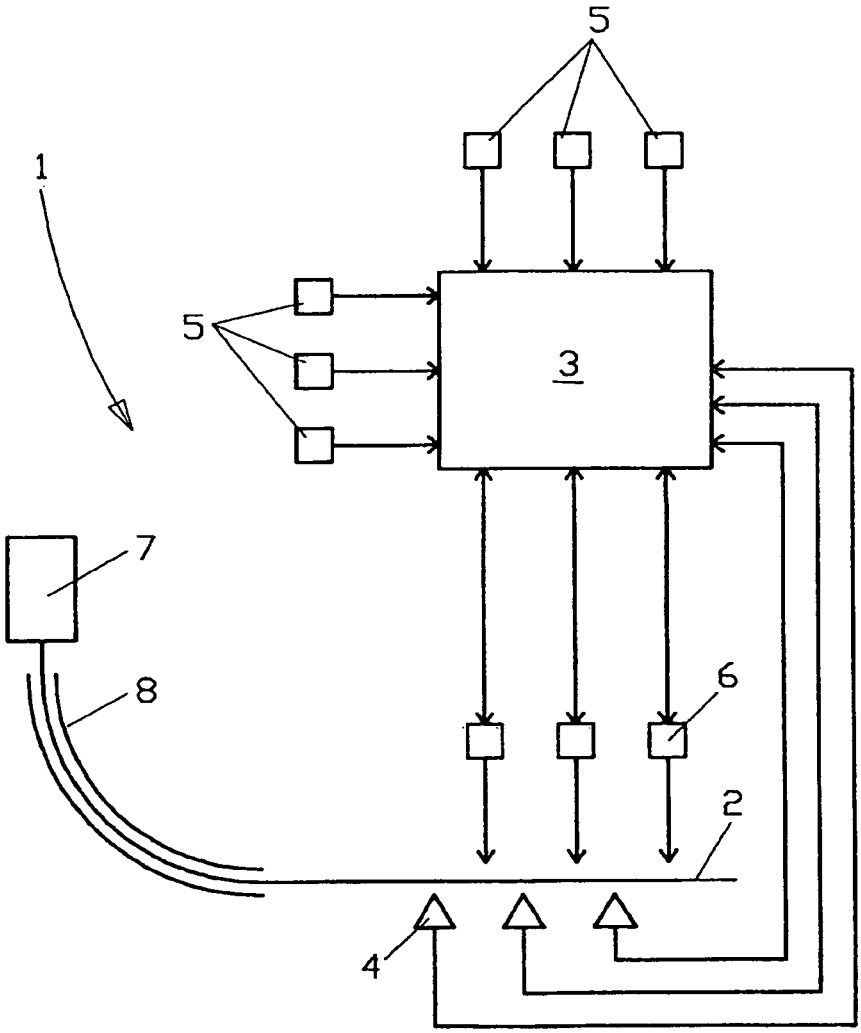

| | | | | |
|---|---|---|---|---|
| 5,988,259 | A * | 11/1999 | Welker et al. | 164/455 |
| 6,225,609 | B1 * | 5/2001 | Imanari et al. | 219/494 |
| 6,386,271 | B1 * | 5/2002 | Kawamoto et al. | 164/472 |
| 6,880,616 | B1 | 4/2005 | Kemna | |
| 6,885,907 | B1 * | 4/2005 | Zhang et al. | 700/146 |
| 2002/0050336 | A1 * | 5/2002 | Ebisu et al. | 164/502 |
| 2002/0189782 | A1 * | 12/2002 | Ashburn | 164/454 |
| 2007/0251663 | A1 * | 11/2007 | Sheldon et al. | 164/455 |

FOREIGN PATENT DOCUMENTS

| | | |
|---|---|---|
| DE | 4417808 | 12/1994 |
| DE | 10255550 | 1/2004 |
| DE | 102005049151 | 4/2007 |
| EP | 1289691 | 6/2001 |
| EP | 1550523 | 7/2005 |
| EP | 1731243 | 12/2006 |
| JP | 56151155 | 11/1981 |
| WO | WO 2005/120747 | 12/2005 |

OTHER PUBLICATIONS

Brimacombe (The Challenge of Quality in Continuous Casting Processes, 1996).*

Sengupta et al., Understanding the Role Water Cooling Plays during Continuous Casting of Steel and Aluminum Alloys, 2004).*

Hoedle et al., Advanced Equipment for High Performance Casters, MPT International Mar. 2003, pp. 74-80.

Moerwald et al., Roll Load Measurement on Thin Slab Caster for Liquid Core Detection, Ironmaking and Steelmaking, 1998, V. 25, No. 2, pp. 159-162.

Narzt et al., Produktinnovationen und Qualitaetsverbesserungen beim Brammenstranggiessen, stahl und eisen 123 (2003) No. 5, pp. 77-82.

* cited by examiner

METHOD OF AND DEVICE FOR CONTROLLING OR REGULATING A TEMPERATURE

TECHNICAL FIELD

The invention relates to a method of controlling or regulating a temperature as, in particular, in a secondary cooling in continuous casting installations.

STATE OF THE ART

In continuous casting installations, a strand of a cast product behind the mold is cooled to a complete solidification in so-called secondary cooling. This cooling plays a decisive role for the material quality of the strand. A complete solidification should take place within the roller segments of the continuous casting installation which support the strand with a liquid core. The object is to so measure the cooling rate of the strand cooling and the temperature region that the cast strand solidifies error-free.

In continuous casting installations according to the state of the art, cooling is realized by using spray water, wherein the amount of the spray water is controlled in accordance with spray water tables. These spray water tables contain, according to the state of the art, a separately determined amount of the cooling water for spray water for each cooling zone. For different casting speeds, a determined therefor, water amount is preset. Dependent on the material of the strand, an operator of the installation selects a suitable table that was drawn for adjusting the water amount in the secondary cooling. Handling of a large number of different tables for different operational condition during a working day of casting is expensive and time-consuming.

DESCRIPTION OF THE INVENTION, OBJECT, SOLUTION, ADVANTAGES

The object of the present invention is to provide a device for and a method of controlling or regulating the temperature and which should reduce or completely eliminate the drawbacks of the state of the art.

According to the invention, this object is achieved, with respect to the method, with a method of controlling or regulating a temperature of a cast strand in a casting installation with a control or regulation unit, in particular for controlling or regulating the temperature in a secondary cooling of the casting installation with at least one means of cooling the cast strand wherein dynamic change at least of a set temperature of the cast strand on the basis of data and/or signal which the control or regulation unit receives and/or determines.

Thereby, the following advantage is achieved that the set temperature for controlling the secondary cooling automatically and dynamically adapted to the actual facts. Thereby, it became at least partially unnecessary for the operator to handle numerous tables still necessary in the state of the art. The set temperatures, as a rule, are so preset that a normal operation with expected casting parameters (e.g., casting temperature, casting speed) is possible. Because in practice, these parameters, nevertheless, fall below or are exceeded or the change of the speed can result in diminishing of the quality of the to be treated material, the invention contemplates a dynamic adaptation of set temperatures to actual facts, i.e., to possibly changing casting parameters. When eventually the casting parameters are again in the expected range, the set temperatures are again adjusted to their initial values. This control/regulation of the set temperatures is carried out in an individual/separate module within the common control and regulation unit.

Data and/or signals, which the control or regulation unit receives or determines are, in particular, temperature values of the cast strand at least in one position, wherein the temperature value is either calculated or measured. In the case when calculation of the temperature value is carried out, in addition to the calculation, advantageously, measurement of the temperature of the strand can be carried out, for comparing the temperature calculation with the measurement.

The control or regulation unit determines, based on the received and determined data and/or signals, the condition of the cast strand at least in one position and controls or regulates in a second module, taken into the consideration the adapted set temperature and the requirements of the casting process, the temperature of the strand in the one position by suitable cooling.

It is advantageous when a dynamic adaptation of set temperature of the cast strand at least in the one position is carried out dependent on an exit temperature of the cast strand from a mold.

According to a further inventive idea, it can be advantageous when the control or regulation unit, based on determined and/or received data or signals, determines bending of the strand or of the strand shell between at least separate rollers. At that, it is advantageous when the control or regulation unit based on determined and/or received data or signals, determines elongation of the strand or the strand shell between at least separate rollers. It is also advantageous when a value of the determined bending and/or elongation is compared with a limiting value and upon exceeding the limiting value, a warning is issued. It is also advantageous when a value of the determined bending and/or elongation is compared with a limiting value and upon exceeding the limiting value, reduction of the set temperature of the strand is carried out in a region of the strand in which the excess is produced. Still further, it is advantageous when adaptation of the set temperature is carried out in such a way that, essentially, the bending and/or elongation do not exceed the limiting value in the entire region of the secondary cooling.

According to a further inventive idea, it is advantageous when the control or regulation unit based on determined and/or received data or signals, determines ductility of the strand. At that, it is beneficial when the determined ductility of the strand is compared with a limiting of the ductility value and upon exceeding the limiting value, a warning is issued. It is also advantageous when the determined ductility of the strand is compared with the value and upon exceeding the limiting value, and increase of the set temperature is triggered. It is further advantageous when the determination of the ductility of the strand is preferably carried out for a region in front of a bending and/or straightening unit of the casting installation.

According to a yet further inventive idea, it is advantageous when the control or regulation unit, based on determined and/or received data or signals, determines a solidification length of the strand. It is further advantageous when the determined solidification length of the strand is compared with a preset limiting value and upon exceeding the limiting value, an increase of the set temperature of the strand is triggered. It is further advantageous when the control or regulation unit so select the set temperature, that the limiting value is essentially reached.

With regard to the device, the object of the invention is achieved with a device for controlling or regulating a temperature of a cast strand in a casting installation with a control or regulation unit, in particular for controlling or regulating the temperature in a secondary cooling of the casting installation with at least one means of cooling the cast strand, wherein a dynamic change of at least one set temperature of the cast strand is carried out based on data and/or signals which the control or regulation unit receives and/or determines. This device, advantageously, can be used for carrying out the above-mentioned method.

The requirements to the secondary cooling are very diverse. E.g., a complete use of the available production capacity, e.g., the use of the available strand support for solidification length essentially up to the end, can constitute a control parameter.

During the regulation of the strand temperature, the calculated solidification length can be taken into consideration, when controlling or regulating the temperature or cooling.

As a further advantageous parameter for controlling cooling, achieving and maintaining of at least individual quality parameters of the strand can be used, wherein a portion of new steel grades is sensitive to unfavorable cooling course, so that the cooling rate constitutes here a control parameter in order to favorably influence the strip quality.

E.g., with the change of the casting speed, the strand temperature at the mold outlet also changes and the following cooling should take this into account, so that no quality problems, e.g., in form of too high thermal stresses, which can lead to fissures in many sensitive steel grades, arise.

With the use of temperature control or temperature regulation, it is advantageous when the set temperature for the cast strand is preset at different positions, and those can be adapted to changing conditions, based on changing parameters.

Further, the strand in the casting installation has a tendency to bulge between the supporting rollers. At a too large bulging, high bending stresses and inner elongation partially occur. Those again can lead to damage of the strand. The maximal allowable bulging advantageously depends on the preset casting parameters, e.g., from casting speed and/or casting temperature.

In the case when the strand is bent or straightened, the strand is subjected to additional elongations and stresses. The strand material, then, should be able to withstand the additional elongations and stresses, without formation of noticeable fissures. When the strand is brittle, surface fissures can be formed.

In order to prevent such fissures to a most possible extent, it is advantageous when the strand is bent or straightened in a temperature range in which the strand is suitably ductile.

Advantageous further developments are described in subclaims.

SHORT DESCRIPTION OF THE DRAWINGS

Figure 2:
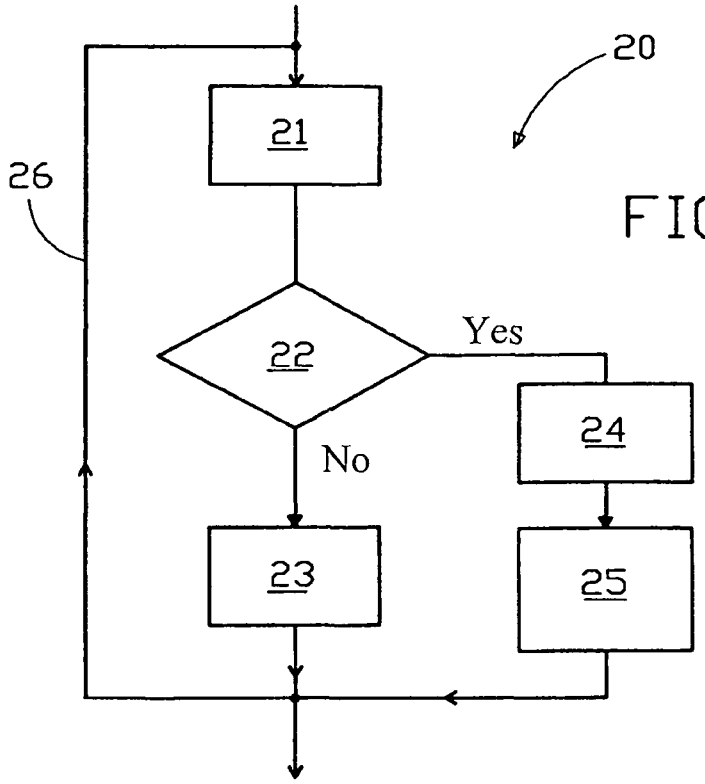
Figure 3:
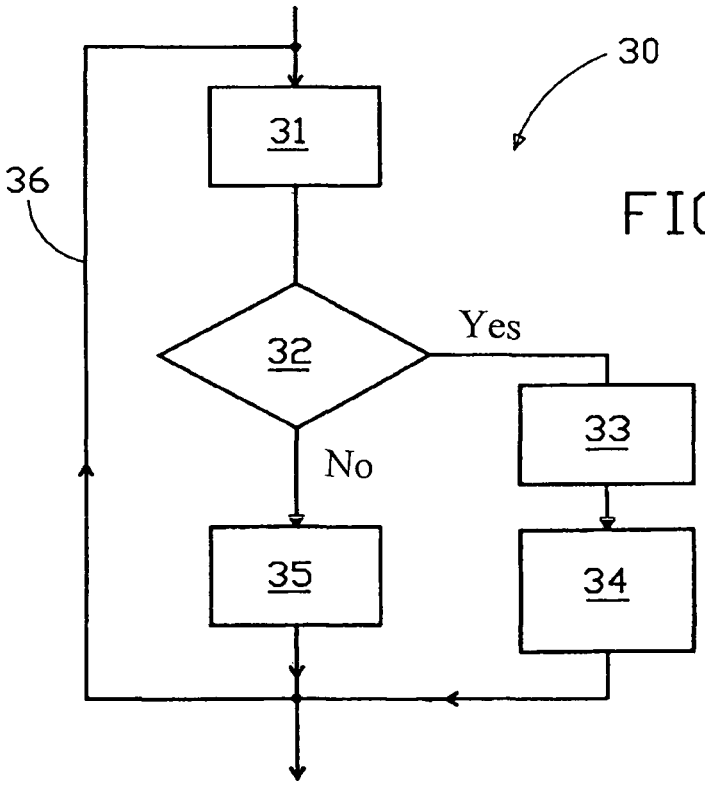
Figure 4:
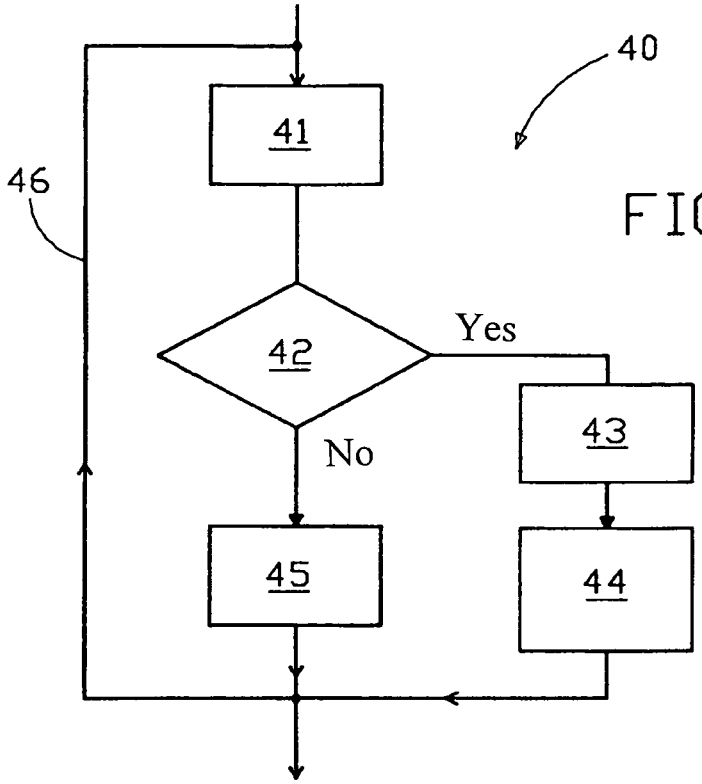
Figure 5:
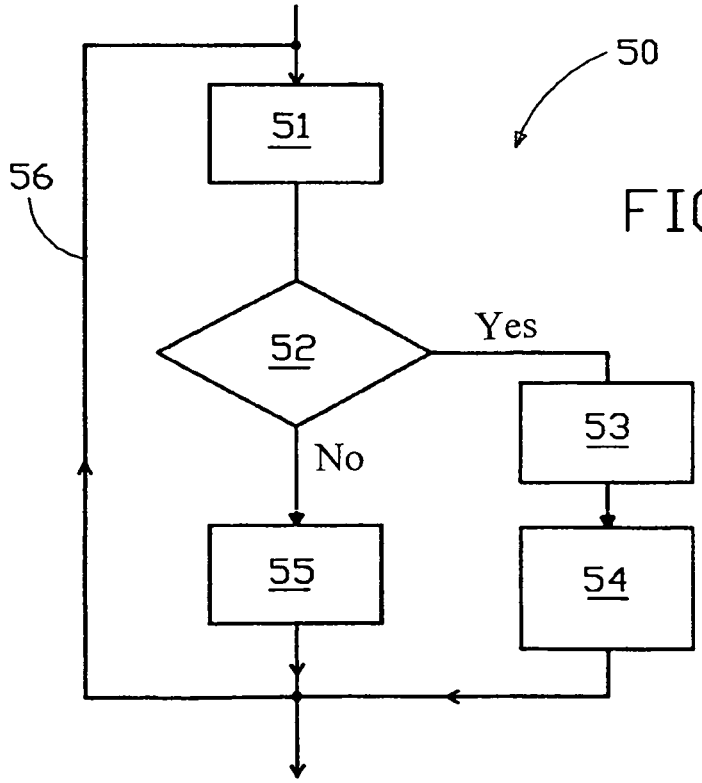

Below, the invention will be described in detail based on an embodiment with limiting to the drawings. The drawings show:

FIG. 1 a schematic view for explaining a device according to the present invention;

FIG. 2 a diagram for explaining a method according to the invention;

FIG. 3 a diagram for explaining a method according to the invention;

FIG. 4 a diagram for explaining a method according to the invention;

FIG. 5 a diagram for explaining a method according to the invention; and

Figure 6:
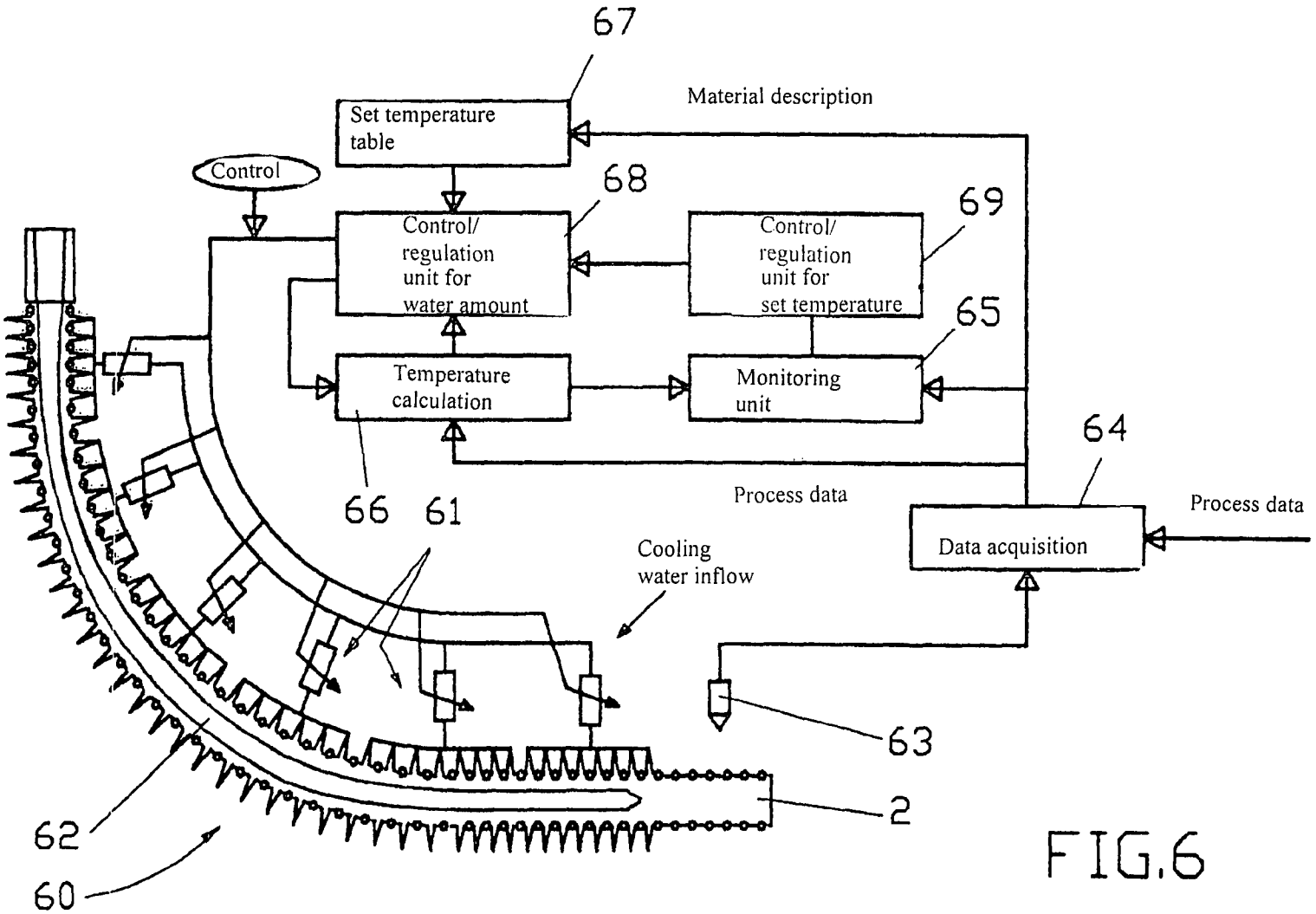

FIG. 6 a diagram for explaining the invention.

PREFERRED EMBODIMENT OF THE INVENTION

The invention relates to control process or regulation process, in particular, for secondary cooling of a continuous casting installation. To this end, FIG. 1 shows schematically a continuous casting installation 1 with a mold 7 and a strand guide 8 for a cast strand 2. The carried-out control or regulation of the temperature is carried out automatically, without intervention of an operator, or semi-automatically, wherein, in this case, the control or regulation unit 3 analyses the condition of the installation 1 based on available measurement data and provides suggestions to the operator for adjusting different control variables.

The continuous casting installation 1 has, in addition to the control and regulation unit 3, also means 4, 5 for acquisition of data or signals such as, e.g., sensors. E.g., temperature sensors 4 are arranged along the strand 2. The means 4, 5 acquires, i.e., detects or calculates the state variable of the strand or the continuous casting installation and communicates them to the control or regulation unit 3 which based on the signals and/or data, dynamically evaluates the control temperature or temperatures of the strand 2 and, based on the same, controls achievement of the set temperature in respective regions of the strand 2. According to the invention, the change of the control or set temperature is effective in such a way that a dynamic adaptation of the set temperature is effected dependent on the given temperatures of the cast strand 2. Advantageously, calculation of the temperature of the cast strand is effected, and regulation of cooling or of the amount of spray water is carried out in order to achieve the set temperature by regulation. Advantageously, a catalogue of temperature curves is used. According to the invention, advantageously, a monitoring module of the temperature calculation is provided, and in this monitoring module, bulging, ductility, and shifting of the through solidification to the installation end is determined. The determined values are compared with the threshold values and either a warning is issued and/or a dynamic adaptation of the set temperature or set temperatures is undertaken. To this end, limiting is made to FIG. 6.

It is advantageous, when the thermal stresses in the strand shell are reduced at the mold outlet. It is further advantageous when the control or regulation reduces or prevents operational states in which bulging of the strand between rollers becomes too big. It is also advantageous when the control or regulation reduces or prevents operational states in which the strand is bent or straightened in temperature region in which the strand material is brittle. In addition, it is advantageous when the control or regulation of the solidification length of the strand is monitored and, preferably, prevented or reduced to a most possible extent so that the solidification length of the strand is not longer than the distance to the end of the strand support, so that the strand is essentially already solidified behind the end of the strand support.

The inventive control method of controlling or regulating the temperature during secondary cooling of the cast strand is based on the temperature regulation, wherein at least one, however, preferably, several set temperature distributions for the strand surface are stored as selected preset values in a memory of the control or regulation unit.

In addition, it is available in the control or regulation unit 3, a stored data set such as, e.g., a chart in which a suitable set temperature distribution is associated with each usable material or with each usable or treatable group of material.

The control and regulation unit 3 controls, based on stored and selected data, the amounts of cooling water for secondary cooling so that the strand temperatures at least essentially correspond to set temperatures.

According to the invention, the control or regulation is so optimized that the set temperature distribution of the strand is not fixed for all operational states and, thus, is not binding, but rather the set temperature distribution is dynamically adapted according to predetermined criteria.

The control or regulation unit contains, in addition to calculation of strand temperatures and the primary control unit for setting water amounts, advantageously, also further modules for effecting additional tasks.

Advantageously, the discharge temperature of the strand discharged from the mold or at cooling segment following the mold, is calculated. FIG. 2 shows a diagram 20 of an inventive method, wherein in block 21, the temperature of the cast strand at the mold outlet on at the cooling segment following the mold is inquired. In block 22, it is inquired whether the determined temperature or the determined cooling rate is greater than the predetermined threshold value or the predetermined cooling rate between the mold and the cooling segment. If the response is Yes, then in block 24, is preset that a warning can issue. In block 25, increase or decrease of the set temperature is controlled, and a reduced or increased cooling of the strand in the outlet region is triggered so that the temperature or the cooling rate of the strand is adjusted to below the allowable threshold. If the response to inquiry in block 22 is No, no change of the set temperature in block 23 is undertaken. This method can be continuously monitored and carried out, and this method step can be communicated back via line 26.

The set temperatures of the strand for the first cooling segment are then adapted to the determined discharge temperature. Thereby, a uniform cooling profile is obtained for strand, together with reduction of the thermal stresses.

Further, bulging of the strand can be calculated and, additionally, an allowable bulging of the strand can be determined. The allowable bulging can depend, e.g., from instantaneous process parameters of the continuous casting installation. FIG. 3 shows a diagram 30 of the inventive method, wherein in block 31, it is inquired how large the bulge of the strand between the segment supports is. In block 32, it is inquired whether the determined bulge is larger than the predetermined threshold value, and wherein the threshold value can be preset differently from region to region. If a response to this inquiry is Yes, then in block 33, a warning can be issued. In block 34, reduction of the set temperature of the strand is controlled, and an increased cooling of the strand in the region of the bulge or in front is so controlled that the temperature of strand is reduced at least there. If the response to inquiry in block 32 is No, no change of the set temperature is undertaken, see block 35. This method can be quasi continuously monitored and effected, that is why this method step can be communicated back via line 36.

The control or regulation unit 3 compares, during casting, preferably continuously or with intervals, the detected or calculated bulge of the cast strand with a maximum allowable value. If this value is exceeded, the set temperature is reduced. The set temperature is preferably so reduced in the region of the cast strand where the excess is recognized, wherein, if necessary, the set temperature can also be reduced in a stretch in front.

According to the inventive idea, a further calculation module in the control or regulation unit 3 can determine the ductility of the strand. A comparison between a predetermined value of ductility with an allowable minimal value can be carried out. If this threshold value of the ductility in the bending or straightening unit is exceeded, the set temperature is increased by the control or regulation unit, wherein this preferably takes place at least in the cooling segment in front of the region of the bending or straightening unit. With regard to the above, limiting is made to FIG. 4, which shows a diagram 40 of the inventive method, wherein in block 41, it is inquired how large is the ductility of the strand, preferably in the bending or straightening unit. In block 42, it is inquired whether the obtained ductility is smaller than that of the predetermined threshold, wherein the threshold can vary from region to region. If the response to the inquiry is Yes, it is proceeded in block 43, where a warning can issue. In block 44, reduction of the set temperature of the strand is triggered so that an increased cooling of the strand in the region of the reduced ductility is triggered, so that the temperature of the strand at least there or at least in a peceding region cools down. If the response to inquiry is No, no change of the set temperature is undertaken, see block 45. This process can be continuously monitored and carried out, wherein this process step can be lead back via a loop 46.

Further, according to an embodiment of the invention, the control or regulation unit 3 can calculate or determine the solidification length of the strand 2 and monitor it based on sensor signals. Because the strand is supported by support segments, it is expedient when the solidification length does not exceed the maximal distance of the last supporting segment in the displacement direction. Thereby, advantageously, the strand is already solidified before it leaves the last supporting segments. The solidification length for the strand according to a predetermined threshold value ends before the last segment. The threshold value can be monitored with a sensor, so that upon the solidification length exceeding the threshold value, the control or regulation unit 3 carries out counter-control measures. Based on the current dynamic behavior, the expected solidification length is assessed. When the solidification length of the strand exceeds the threshold value, the control or regulation unit causes reduction of the set temperature at least in one region before the solidification length reaches the threshold value so that the solidification length is reduced. This is caused by a strong strand cooling which makes the solidification length shorter. The threshold advantageously is so selected that during the control or regulation process, the solidification length does not exceed or does not substantially exceed the threshold value, and ends behind the supporting segments. In connection with this, limiting is made to FIG. 5 that shows a diagram 50 of the corresponding process, wherein in block 51, it is inquired or dynamically assessed how long the solidification length is. In block 52, it is inquired whether the obtained solidification length is greater than the predetermined threshold. If the response to the inquiry is yes, it is preceded in block 53, where a warning can issue. In block 54, reduction of the set temperature is triggered which triggers a strong cooling of the strand so that the temperature of the strand at least in an advantageous region is reduced, and the strand solidification length is reduced. If in block 52 the response to the inquiry is No, no change of the set temperature is undertaken, see block 55. This process can be continuously monitored and carried out, wherein this process step can be lead back via a loop 56.

It should be explicitly pointed out that the process sequences shown in FIGS. 2 through 5 can be combined with each other, so that at least separate process steps or sequences can run parallel with each other or after each other, so that several parameters can influence the adjustment or trigger a change of the set temperature of the cast strand at least in separate regions.

FIG. 6 shows schematically a casting installation 60 in which there are provided cooling segments 61 for cooling the cast strand 62. With sensors 63 or multiplicity of sensors, the temperature of the cast strand can be determined in order, e.g., to compare the previously calculated cast strand temperature with the measurement. The temperature data of the sensors or sensors 63 are communicated to data acquisition 64 to which other process data are communicated. The data of the data acquisition 64 are communicated to monitoring unit 65, temperature calculation 66, and the set temperature table 67. The monitoring unit 65 also obtains data from temperature calculation 66 that also forwards data to control of regulation unit 68 for the amount of water of cooling, wherein the temperature calculation 66 receives a feedback from the control/regulation unit 68. The monitoring unit 65 communicates data to the control regulation unit 69 for the set temperature which further communicates data to the control regulation unit 68 that controls the cooling segments 61. In the monitoring unit 65, bulging, ductility, and the distance of the solidification to the installation end are determined. Those are compared with the thresholds, as described in FIGS. 3, 4, 5 and the specification, as discussed above. At deviation from threshold values, either only a warning is issued or the set temperature is changed.

LIST OF LIMITING NUMERALS

1 Continuous casting installation
2 Cast strand
3 Control or regulation unit
5 Means for data or signal acquisition
6 Means for data or signal acquisition
7 Means for applying cooling medium
20 Diagram
21 Block
22 Block
23 Block
24 Block
25 Block
26 Block
30 Diagram
31 Block
32 Block
33 Block
34 Block
35 Block
36 Block
40 Diagram
41 Block
42 Block
43 Block
44 Block
45 Block
46 Block
50 Diagram
51 Block
52 Block
53 Block
54 Block
55 Block
56 Block
60 Casting installation
62 Cast strand
63 Sensor
64 Block
65 Block
66 Block
67 Block
68 Block
69 Block

The invention claimed is:

1. A method of controlling a temperature of a cast strand (2) in a secondary cooling of a cast installation (1) having at least one means for cooling the cast strand (2), a control or regulation unit (3), and at least one temperature sensor (4), the method comprising the steps of:

dynamically adapting a set temperature of the cast strand in at least one position thereof dependent on an exit temperature of the cast strand (2) from a mold;

dynamically changing the dynamically adapted set temperature of the cast strand (2) based on at least one of data and signals which the control or regulation unit (3) acquires, wherein the control or regulation unit (3) determines, respectively, based on the at least one of data and signals, bending and elongation of the strand and strand shell, ductility of the strand (2), and a solidification length of the cast strand, by comparing the at least one of data and signals with a respective threshold value, and generates a control signal for changing the dynamically adapted set temperature, taking into account an actual cast strand temperature in the at least one position; and adjusting the actual temperature of the cast strand with the at least one cooling means based on the dynamically adapted and changed set temperature.

2. A method according to claim 1, wherein the control or regulation unit operates to maintain the at least one of bending and elongation of the strand and stand shell, ductility of the strand and a solidification length of the cast strand substantially unchanged.

* * * * *